US005893543A

United States Patent [19]

Emery et al.

[11] Patent Number: 5,893,543

[45] Date of Patent: Apr. 13, 1999

[54] LOCKING DEVICE FOR SUCTION CUP ADHESION

[75] Inventors: William W. Emery, Berkeley Heights; Russell A. Fritts, Warren, both of N.J.

[73] Assignee: Better Sleep Mfg. Co., Berkeley Heights, N.J.

[21] Appl. No.: 08/841,241

[22] Filed: Apr. 29, 1997

Related U.S. Application Data

[63] Continuation-in-part of application No. 08/572,661, Dec. 14, 1995, Pat. No. 5,657,954.

[51] Int. Cl.[6] ..... A45D 42/14

[52] U.S. Cl. ..... 248/205.5; 248/683

[58] Field of Search ..... 248/205.5, 205.6, 248/206.1, 206.2, 206.3, 683, 362, 205.7, 205.8, 205.9, 206.4

[56] References Cited

U.S. PATENT DOCUMENTS

| | | | |
|---|---|---|---|
| D. 121,813 | 8/1940 | Isenberg . | |
| D. 251,522 | 4/1979 | Chapman . | |
| 1,325,143 | 12/1919 | Conterio . | |
| 1,531,694 | 3/1925 | Downing . | |
| 1,694,235 | 12/1928 | Schoenfelder . | |
| 2,044,520 | 6/1936 | Weiant, Jr. . | |
| 3,011,649 | 12/1961 | Porter | 248/205.5 X |
| 3,176,602 | 4/1965 | Wilt . | |
| 3,185,537 | 5/1965 | Wright . | |
| 4,889,141 | 12/1989 | Lindsey . | |
| 4,938,346 | 7/1990 | Urbano . | |
| 5,014,860 | 5/1991 | Emery . | |
| 5,039,046 | 8/1991 | Brewster . | |
| 5,289,927 | 3/1994 | Emery . | |
| 5,595,364 | 1/1997 | Protz, Jr. | 248/205.5 |
| 5,673,884 | 10/1997 | Yemini | 248/220.21 X |

*Primary Examiner*—Ramon O. Ramirez

*Attorney, Agent, or Firm*—Hopgood, Calimafde, Kalil & Judlowe, LLP

[57] ABSTRACT

Disclosed is an improved device for adhesion of suction cup mounted assemblies comprising novel combinations of lock devices and innovative suction cups for enhanced holding of mounted assemblies to flat surfaces.

8 Claims, 6 Drawing Sheets

LOCKING DEVICE FOR SUCTION CUP ADHESION

RELATED APPLICATIONS

This is a continuation-in-part of application Ser. No. 08/572,661 filed Dec. 14, 1995, which issued as U.S. Pat. No. 5,657,954, and which is incorporated by reference herein as if restated in full.

FIELD OF INVENTION

The present invention relates to improvements for adhesion of suction cup mounted assemblies, and more particularly to novel suction cup locking means for enhancing the hold of mounted assemblies onto surfaces.

BACKGROUND OF THE INVENTION

Assemblies for organizing household articles suspended on non-porous surfaces such as tile, glass and walls have evolved over the past decade with increased popularity based on convenience and design choice. For instance, Lindsey U.S. Pat. No. 4,889,141 describes a shower kit for holding toiletries, and Urbano U.S. Pat. No. 4,938,346 describes a wall-mounted soap dish, both of which are adapted to attach onto non-porous surfaces via suction cups.

Some art-recognized devices are suspended from the shower arm or pipe which extends from the wall of a bath area and are stabilized with suction cups on the lower aspects of the assembly. A representative example is provided in Chapman Design Pat. No. 251,522 which depicts a coated wire frame shower caddy for holding toiletries which is stabilized from side-ways movement with split tunnel suction cups. In such suction cups, the point of attachment to the wire frame is a slit in the rear or "knob" of the suction cup which engages the coated wire, parallel with respect to the plane of the attachment surface.

Another example is provided in Schoenfelder U.S. Pat. No. 1,694,235 which describes a coated wire frame soap dish for attaching to a non-porous surface with knob-piercing suction cups. The coated wire frame assembly provides specific arms for penetrating the rear knob of the suction cup perpendicularly with respect to the plane of the attachment surface. Variations in the knob-piercing-type suction cups include those described in Conteiro U.S. Pat. No. 1,325,143 and Wilt U.S. Pat. No. 3,179,602. More specifically, Conteiro describes a corner mounted, shower bracket for holding bath articles which uses a plurality of knob-piercing suction cups designed to be pierced with conventional screws which hold the knobs against mounting bars. Similarly, Wilt discloses an automobile dash mount which uses a knob-piercing suction cup for penetration by a conventional screw which holds the pierced knob against a mounting bracket.

A second type of suction cup is referred to herein as a "button knob" suction cup. Such suction cups do not require holes in the rear knobs for attachment and examples are described in Isenberg Design Pat. No. 121,813, Wright U.S. Pat. No. 3,185,537 and Brewster U.S. Pat. No. 5,039,046. Essentially, all three patents show assemblies for vertical suspension from flat, non-porous surfaces via button knob suction cups. These cups have a frontal aspect having the suction portion for adhering to a flat surface and a rear portion comprised of a knob onto which is suspended the weight of the holding assembly.

More specifically, Isenberg discloses a coated wire frame soap dish which is adapted to be suspended from button knobs of suction cups which are inserted between adjacent, parallel coated wires and held in place by the bias provided between the parallel wires. Wright shows a molded soap holder having punched holes in the rear walls through which the knobs are inserted, followed by mounting of the suction cups to a non-porous surface wall. The weight of the soap holder is suspended from the punched, non-adjustable holes. Brewster teaches a coated wire, baby bottle holder which have loops formed in the superior aspects of the wire frame for suspending the assembly from button knobs of suction cups.

Downing U.S. Pat. No. 1,531,694 discloses a variant on the button knob suction cup. Downing shows a suction cup with a groove in its rear knob which is adapted for engagement to portions of a key-hole opening in a mounting bracket.

Weiant U.S. Pat. No. 2,044,520 describes a soap dish which is adapted for attachment to a flat surface via suction cups having, in their rear knobs, a hole or tunnel which is parallel with respect to the plane of the flat surface. Emery U.S. Pat. Nos. 5,014,860 and 5,289,927 also disclose suction cups each having a tunnel in the rear knob which is parallel with respect to the plane of the attachment surface. Horizontal portions of the wire frame are inserted into the tunnels on the rear knob of the suction cups and the cups can then slide horizontally along the wire frame for adjustment.

Despite such known improvements, a need yet exists in the art for newer suction cup attachments with improved grip, holding and weight bearing capacity. Accordingly, it is an object of the present invention to provide an improved lock device for holding suction cups for suspending assemblies from flat surfaces.

Another object of the present invention is to provide improvements in suction cups and their corresponding locking members for suspending assemblies from flat surfaces.

These and other objects will become apparent from the disclosure provided hereinbelow.

SUMMARY OF THE INVENTION

The present invention includes a lock device for adjustably holding button knob suction cups for suspending assemblies from flat surfaces comprising at least one open recess edge, each said open recess edge comprised of a substantially semi-circular edge portion with dual elongated edge portions on either sides of said substantially semi-circular edge portion. The substantially semi-circular edge portion is adapted to insert a button knob of a suction cup wherein the lock device is suspended from the button knob of the suction cup. The lock device can also have a plurality of open recess edges for adjustable engagement of the suction cup.

In one embodiment, the suction cup has an engaging member comprised of a flexible concave surface for engaging flat surfaces and a convex surface which is opposite the concave surface and adjacent the button knob. The convex surface can have a plurality of ridges for gripping the semi-circular edge portions of the lock device.

The open recess edge can also be a substantially non-circular edge portion with dual elongated edge portions situated on either sides of the non-circular edge portion. In this alternative, the non-circular edge portion is adapted to insert a suction cup having a shank which is substantially rectinoid in shape. A plurality of such non-circular edge portions for adjustable engagement of rectinoid suction cups is included in this invention.

Another embodiment of the present lock devices is one for holding an assembly having a convex surface to a flat surface using a button knob suction cup. This embodiment has at least one convex mounting bracket having a concave surface opposite a convex surface and a substantially circular edge portion. The substantially circular edge portion is adapted to insert a button knob of a suction cup and the concave surface of the mounting bracket is adapted to conform with the convex surface of the assembly.

The lock device can also comprise at least one mounting bracket having at least one substantially circular edge portion which is adapted to insert a button knob of a suction cup, and a holding member comprising a grip rib for holding the mounting bracket in bias when the button knob is substantially within the circular edge portion. The button knob can also be placed on either sides of the grip rib for adjustable engagement of the suction cup.

The invention includes a suction cup comprised of a flat-surface-engaging member further comprised of a flexible concave surface for engaging a flat surface and a convex surface opposite the concave surface, and a fixture-mounting portion adjacent the concave surface, adapted to hold a fixture assembly. The fixture mounting portion can be L-shaped with the concave surface of the flat-surface-engaging member further comprised of a lock rib, or it can be T-shaped and further comprised of dual lock knobs on either sides of the T-shaped fixture mounting portion. The fixture mounting portion can also be comprised of a ball-mounting socket and with the corresponding fixture assembly having at least one ball pivot.

BRIEF DESCRIPTION OF THE DRAWINGS

For a more complete understanding of this invention, reference is made to the following detailed description of the illustrated embodiments in connection with the accompanying drawings.

DETAILED DESCRIPTION OF THE ILLUSTRATED EMBODIMENTS

Figure 1:
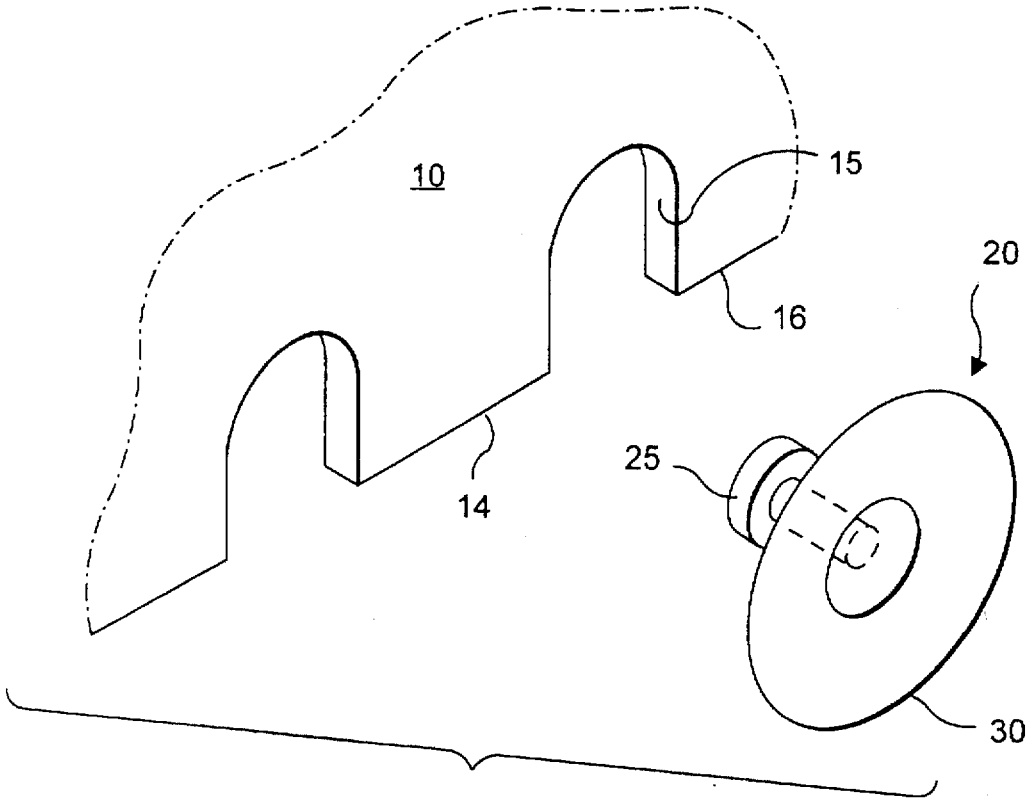
FIG. 1 is a partial, perspective view of one embodiment lock device pursuant to the present invention for holding button knob suction cups.

The present invention will now be described in connection with the figures. FIG. 1 depicts lock device 10 for holding button knob suction cup 20 for suspending assemblies from flat surfaces. Lock device 10 is shown comprised of at least one open recess edge 15 which is a substantially semi-circular edge having elongated edge portions 14 and 16 on either side of open recess edge 15. Semi-circular edge portion 15 is adapted to insert button knob 25 of suction cup 20 so that lock device 10 is suspended from the suction cup. It will be appreciated by one skilled in the art that FIG. 1 only shows a partial, perspective view of lock device 10 and that a plurality of edge portions such as 15 can be provided which are adapted, individually, to insert button knob 25 of suction cup 20 (thus, the remainder of lock device 10 is denoted in phantom lines). This multi-feature allows the suction cup to be placed anywhere along the series of edge portions, providing an adjustable feature so that non-porous areas such as group lines in a shower can be avoided.

Suction cup 20 has concave surface 30 for engaging flat surfaces and convex surface 40 (shown, for example, on suction cup 21 in FIG. 2) opposite the concave surface and adjacent button knob 25. As the terms are used herein, "concave" means curved like the inner surface of a sphere while "convex" means a surface that curves or bulges outward as on the exterior surface of a sphere.

Figure 2:
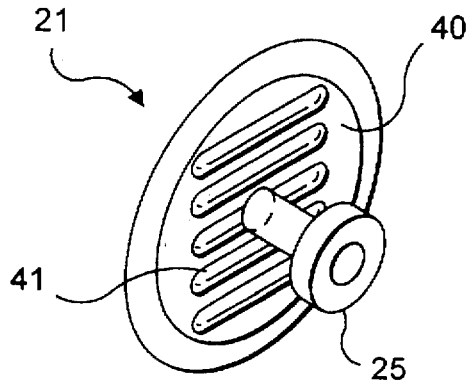
FIG. 2 shows a button knob suction cup having a plurality of ridges on a convex surface in accordance with the present invention.

FIG. 2 shows one of the several suction cup improvements uniquely disclosed herein and, in this case, labeled number 21. Convex surface 40 of suction cup 21 is shown with a plurality of ridges 41 for gripping edge portions of lock devices. The suction cups are made of conventional materials such as latex, vinyl polyethylene plastics or other synthetic elastomers and polymers, which provide a flexible texture and a firm grip on non-porous surfaces. The production of such cups (albeit of known designs other than disclosed herein) are well known in the art such as by injection molding. The addition of ribs 41 enhances the hold on recesses such as 15 shown in FIG. 1.

Figure 3:
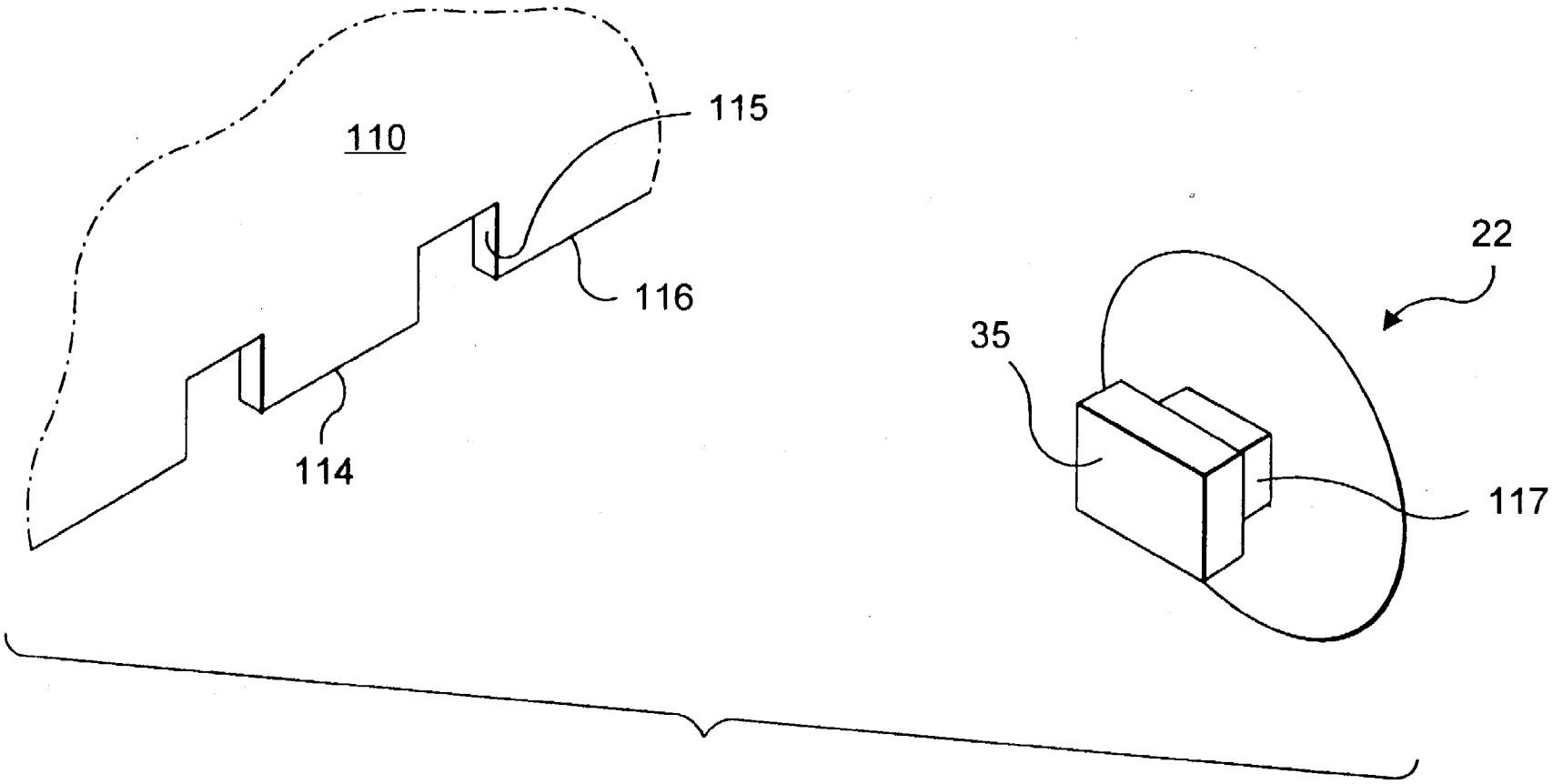
FIG. 3 is a partial, perspective view of an alternative embodiment lock device of the present invention for holding suction cup button knobs which are substantially rectinoid in shape.

Such open recess edges can also be substantially non-circular such as shown in FIG. 3. FIG. 3 depicts a partial, perspective view of alternative lock device 110 for holding suction cup 22. This type of suction cup has button knob 35 and shank 117 which are both substantially rectinoid in shape. Shank 117 is designed to engage rectinoid edge portion 115 so that knob 35 is held thereby which prevents pivoting or twisting by suction cup 22. As the term is used herein, "rectinoid" means either square or rectangular in shape. Rectinoid edge portion 115 has dual elongated edge portions 114 and 116 situated on either sides. As stated above, one skilled in the art can readily see that FIG. 3 shows only a partial, perspective view of lock device 110, and that a plurality of edge portions such as 115 could be provided which are adapted, individually, to insert shank 117 of suction cup 22 (the remainder of lock device 110 is denoted in phantom lines). Again, this multi-feature allows suction cups, such as 22, to be placed anywhere along the series of edge portions, providing an adjustable feature so that group lines can be avoided.

Figure 4A:
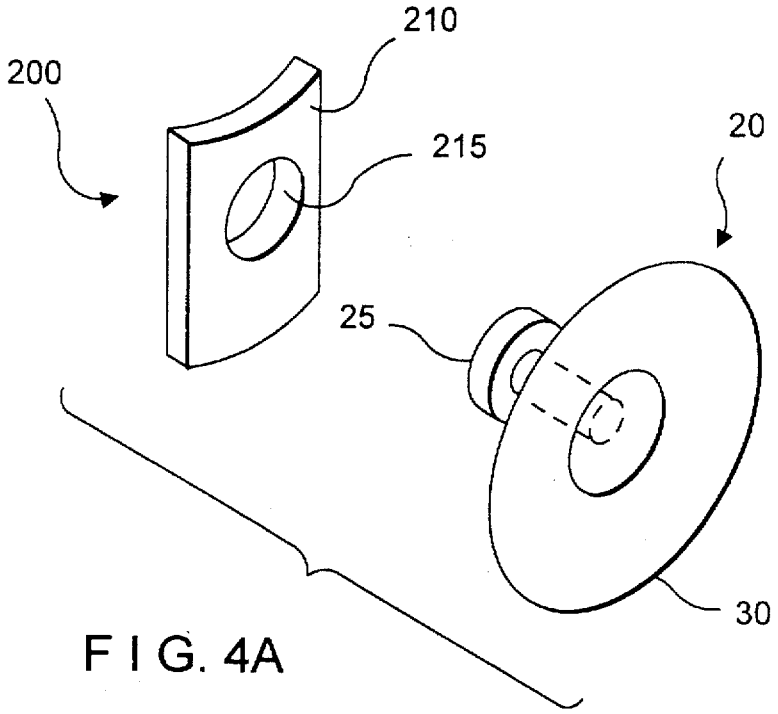
FIGS. 4A and 4B show a convex mounting bracket according to the present invention.
Figure 4B:
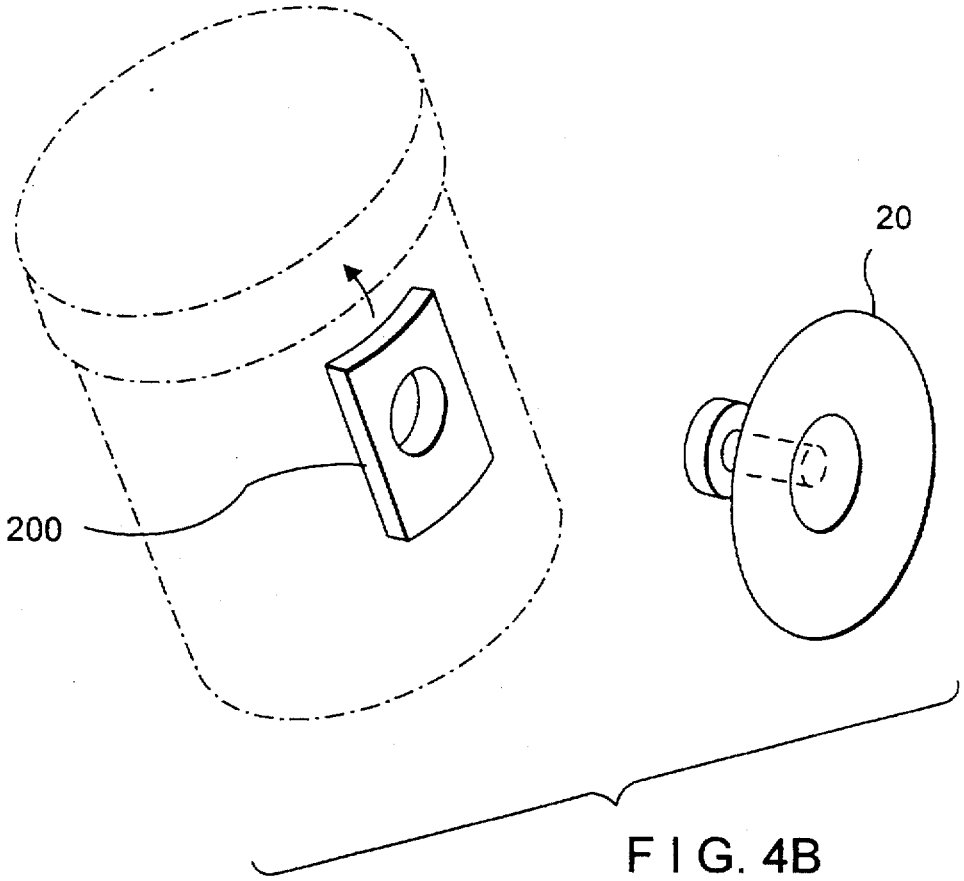

FIG. 4A shows convex mounting bracket 200 which has a convex surface 210 and a substantially circular edge portion 215 which is adapted to insert button knob 25 of suction cup 20. Opposite convex surface 210 of mounting bracket 200 is the corresponding concave surface (not shown) which is adapted to conform with a convex surface of an assembly such as shown in phantom lines in FIG. 4B. For instance, a molded plastic cup having a rim (shown with phantom lines in FIG. 4B) is a contemplated assembly. Convex mounting bracket 200 inserts into the rim and holds the plastic cup. Bracket 200 is then mounted to a flat surface with suction cup 20.

Figure 5:
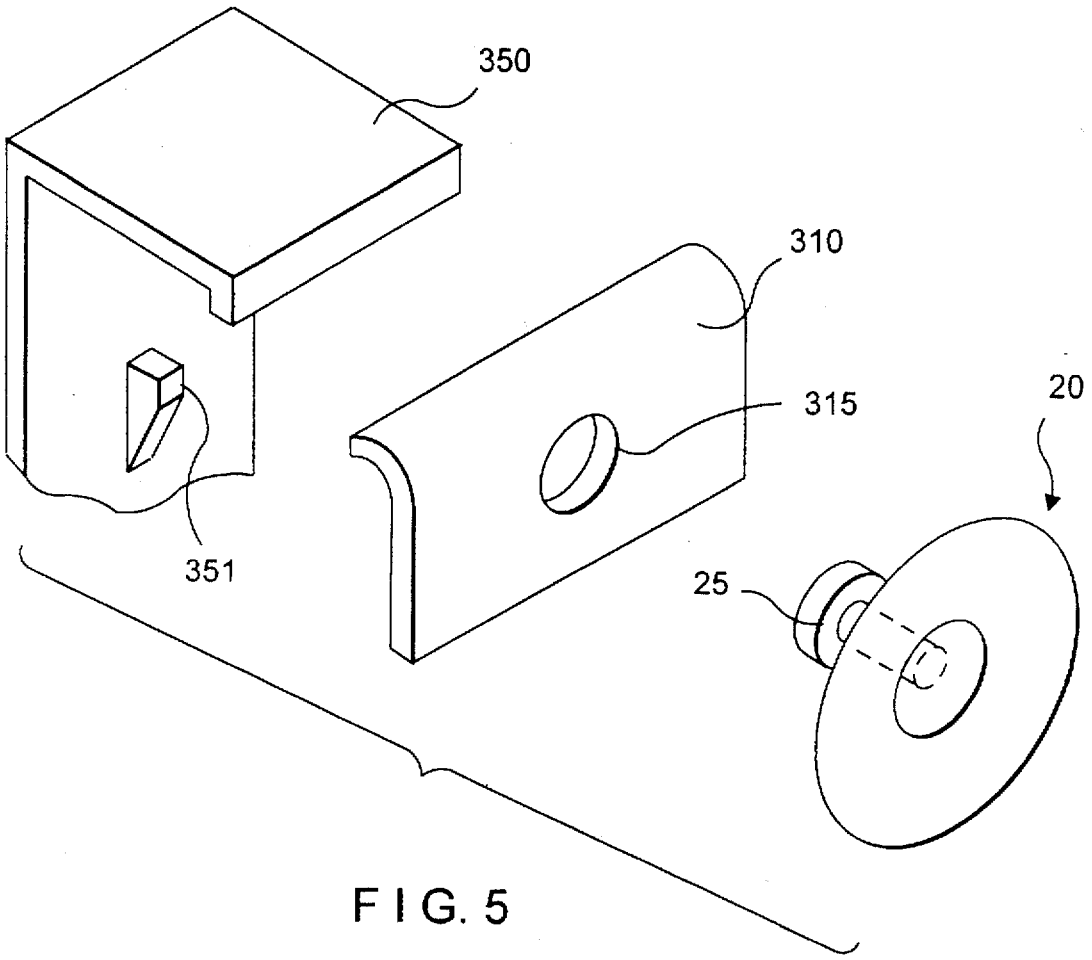
FIG. 5 depicts another embodiment of the present invention wherein a mounting bracket with a circular hole is adapted to insert a button knob suction cup, and a member with a grip rib is adapted for holding the mounting bracket.

FIG. 5 depicts a lock device which comprises mounting bracket 310 and holding member 350. Holding member 350 comprises grip rib 351 for gripping mounting bracket 310. Mounting bracket 310 has a substantially circular edge portion 315 which is adapted to insert button knob 25 of suction cup 20. Grip rib 351 can back button knob 25 in bias when it is substantially within circular edge portion 315, or button knob 25 can be located on either side of rib 351 to provide adjustability, such as to avoid a group line.

Figure 6:
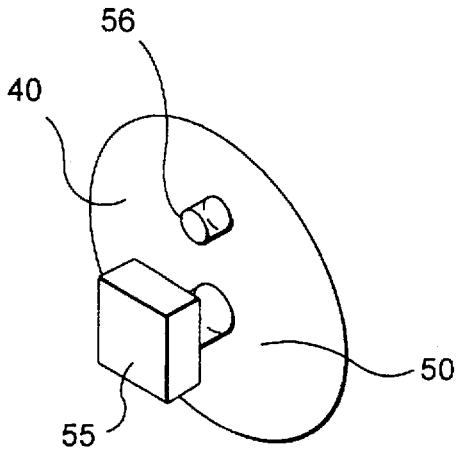
FIG. 6 is an embodiment of a novel suction cup having an L-shaped fixture mounting portion.

The present invention includes various other improvements in suction cups including those shown in FIGS. 6–9. Referring first to FIG. 6, suction cup 23 is comprised of flat-surface-engaging member 50 further comprised of a flexible concave surface (not shown) for engaging a flat surface and convex surface 40 opposite the concave surface, and fixture-mounting portion 55 adjacent the concave surface. Fixture-mounting portion 55 is adapted to hold a fixture assembly with the aid of lock rib 56 which is also formed on convex surface 40. Fixture mounting portion 55 is shown in FIG. 6 as being L-shaped.

Figure 7:
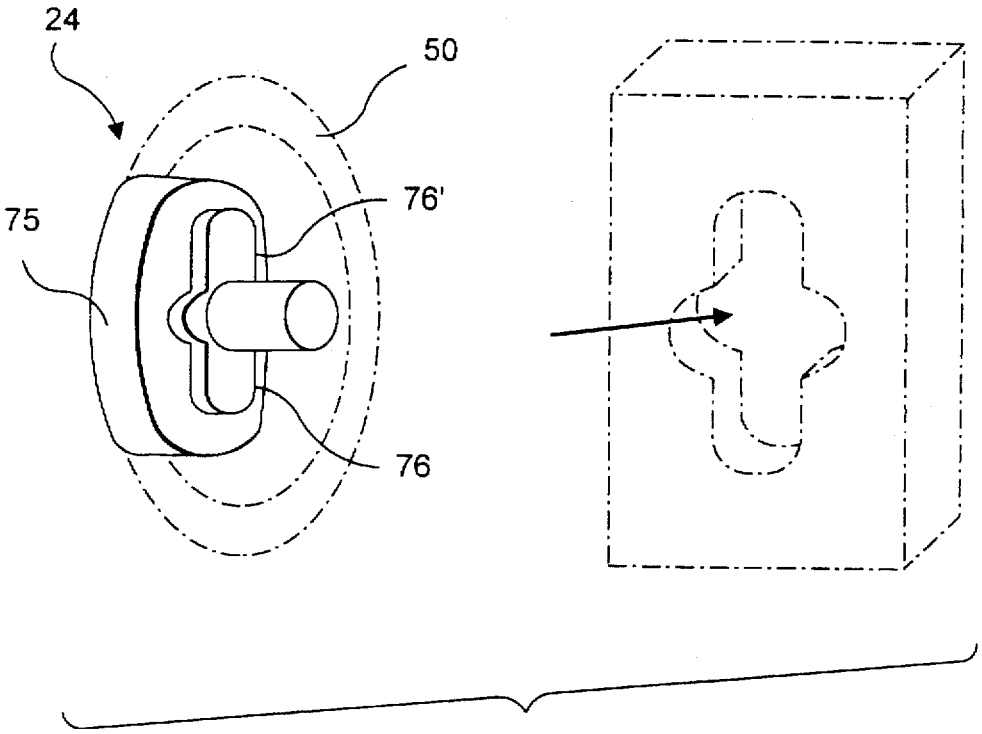
FIGS. 7 and 8 show further embodiments of novel suction cups having a T-shaped fixture mounting portion.

Fixture mounting portion 75 is shown in FIG. 7 as being T-shaped (through flat-surface-engaging member 50 which is made here of a transparent plastic material and depicted with phantom lines) on suction cup 24. Fixture mounting portion 75 is further comprised of dual lock knobs 76 and 76' on either sides of the T-shaped fixture mounting portion. This type of knob can be inserted into specialized "keyhole" edges such as shown with phantom lines in FIG. 7. The arrow in conjunction therewith indicates the insertion of knob 75. The concept provided here is for a "twist and lock" system.

Figure 8:
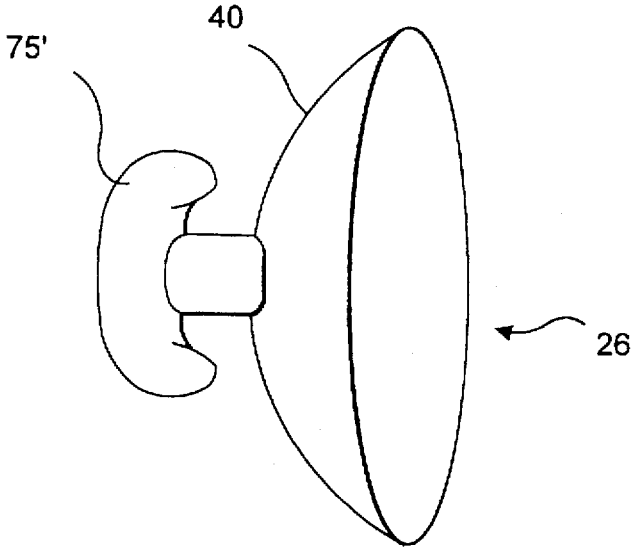

FIG. 8 shows a side elevational view of a variation of the T-shape. Suction cup 26 is shown with T-shaped fixture mounting portion 75' which is designed for insertion into two parallel and spaced metal wires which form conventional metal or plastic coated wire fixtures.

Figure 9:
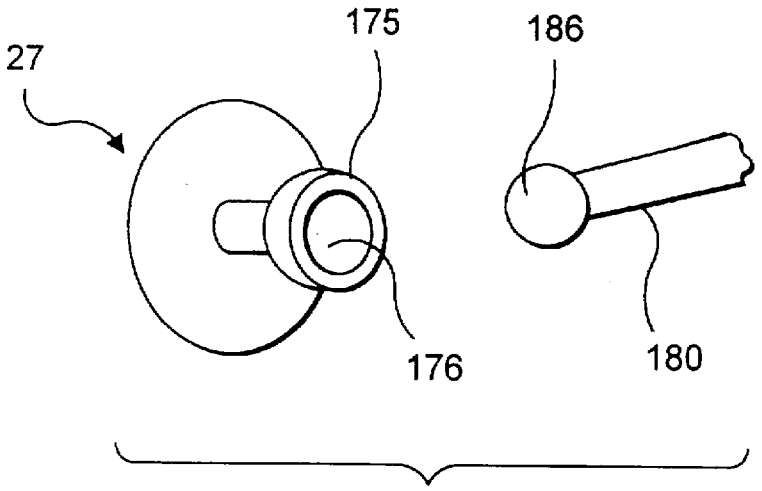
FIG. 9 depicts a ball-mounting socket embodiment of the present invention.

FIG. 9 shows that fixture mounting portion 175 can also be comprised of a ball-mounting socket 176 on suction cup 278. A corresponding fixture assembly 180 (partially shown) is depicted as having a ball pivot 186 for engagement to socket 176.

Figure 10:
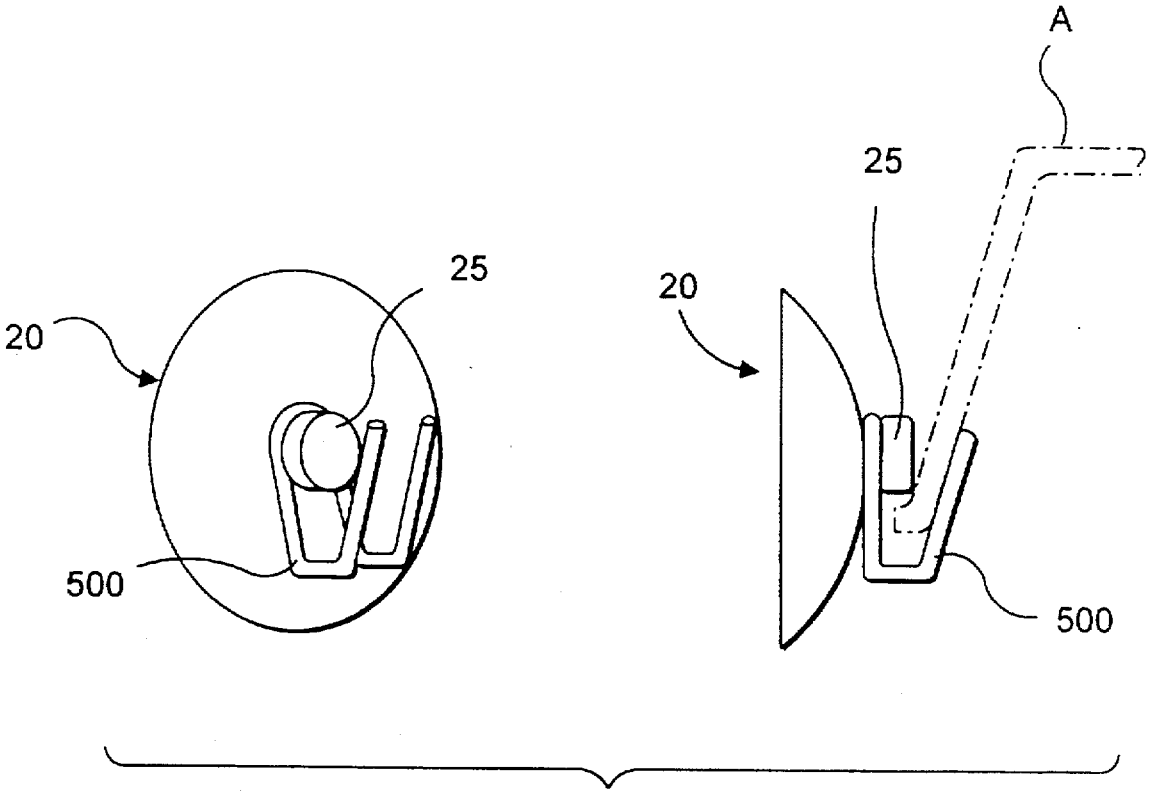
FIG. 10 shows a metal wire clip adapted for holding the knob of a suction cup for mounting assemblies in accordance with the present invention.

FIG. 10 shows metal wire clip 500 adapted for holding knob 25 of suction cup 20 for mounting assemblies such as A. Assembly A can be, by way of example, a shelf. Clip 500 provides bias for holding knob 25 against the shelf. Clip 500 is constructed of metal wires, optionally coated with plastic or an additional metal.

The illustrated embodiments have proven to be useful in many applications for this art. Further modifications based on the disclosure will occur to persons skilled in the art. These modifications are within the scope and spirit of the present invention as defined by the following claims.

What is claimed is:

1. A lock device for holding button knob suction cups for suspending assemblies from flat surfaces, comprising:

at least one mounting bracket, said mounting bracket having at least one substantially circular edge portion, said substantially circular edge portion adapted to insert a button knob of a suction cup; and a holding member comprising a grip rib for holding said bracket in bias when said button knob is substantially within said circular edge portion.

2. The lock device of claim 1 wherein said button knob can be placed on either sides of said rib for adjustable engagement of said suction cup.

3. A suction cup comprised of:

a flat-surface-engaging member, said member comprised of a flexible concave surface for engaging a flat surface and a convex surface opposite said concave surface; and a fixture-mounting portion adjacent said concave surface, said fixture mounting portion adapted to hold a fixture assembly.

4. The suction cup of claim 3, wherein said fixture mounting portion is L-shaped and said concave surface of said member further comprises a lock rib.

5. The suction cup of claim 3, wherein said fixture mounting portion is T-shaped and further comprises dual lock knobs on either sides of said T-shaped fixture mounting portion.

6. The suction cup of claim 3, wherein said fixture mounting portion is T-shaped.

7. The suction cup of claim 3, wherein said fixture mounting portion is comprised of a ball-mounting socket and said fixture assembly has at least one ball pivot.

8. A lock device for holding a button knob suction cup for suspending an assembly having a convex surface from a flat surface, comprising:

at least one convex mounting bracket, said convex mounting bracket having a concave surface and a substantially circular edge portion, said substantially circular edge portion adapted to insert a button knob of a suction cup;

and said concave surface of said mounting bracket adapted for conformation to said convex surface of said assembly, wherein said mounting bracket is adapted for retention of said assembly.

* * * * *